US008401446B2

(12) United States Patent
Robles-Flores

(10) Patent No.: US 8,401,446 B2
(45) Date of Patent: Mar. 19, 2013

(54) VARIABLE PRESSURE TRANSFER ASSIST BLADE

(75) Inventor: Eliud Robles-Flores, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 430 days.

(21) Appl. No.: 12/758,896

(22) Filed: Apr. 13, 2010

(65) Prior Publication Data

US 2011/0249997 A1 Oct. 13, 2011

(51) Int. Cl.
*G03G 15/16* (2006.01)

(52) U.S. Cl. ..... 399/318

(58) Field of Classification Search ..... 399/66, 399/316, 317, 318

See application file for complete search history.

(56) References Cited

U.S. PATENT DOCUMENTS 5,805,957 A * 9/1998 Kodama et al. ..... 399/66
5,923,921 A * 7/1999 OuYang et al. ..... 399/66
6,032,004 A 2/2000 Mirabella, Jr. et al.
2003/0039488 A1 2/2003 Fayette et al.
2003/0039489 A1 2/2003 Obrien et al.
2003/0108369 A1 6/2003 Kuo et al.
2007/0048034 A1 3/2007 Soures et al.
2007/0196144 A1 8/2007 Robles-Flores et al.
2007/0201912 A1 8/2007 Montfort et al.
2010/0046992 A1 * 2/2010 Montfort et al. ..... 399/316

* cited by examiner

*Primary Examiner* — David Gray
*Assistant Examiner* — Thomas Giampaolo, II
(74) *Attorney, Agent, or Firm* — Gibb & Riley, LLC

(57) ABSTRACT

A printing apparatus and method include a charging device positioned adjacent a photoreceptor that places a latent image charge on the photoreceptor. A donor device is adjacent the photoreceptor, and transfers marking material to regions of the photoreceptor that have received the latent image charge. In addition, a media path that is adjacent the photoreceptor causes at least one sheet of media to be placed on the photoreceptor and the marking material. A transfer assist blade that is also adjacent the photoreceptor, presses the sheet of media against the photoreceptor to cause the marking material to be transferred to the sheet of media. The apparatus also includes a controller that is operatively connected to the transfer assist blade. The controller causes the transfer assist blade to apply more pressure to leading and trailing portions of the sheet of media relative to the middle portion of the sheet of media.

20 Claims, 5 Drawing Sheets

VARIABLE PRESSURE TRANSFER ASSIST BLADE

BACKGROUND AND SUMMARY

Embodiments herein generally relate to printing methods and printing systems that utilize transfer assist blades, and more particularly to methods and systems that vary the pressure supplied by the transfer assist blade as a sheet of media passes between the transfer assist blade and the photoconductor.

Often, it is desirable to have printing devices perform printing all the way to the edge of the sheet of media that is being printed on. This is commonly referred to as "print-to-edge" activity. However, print-to-edge performance is a very challenging aspect of printing, especially at the leading edge portion (LE) and trailing edge portion (TE) of the media where the transfer of toner from the photoreceptor (PR) to the media may be influenced by other factors such as reverse biasing in bias transfer belt (BTB) systems or transfer assist blade (TAB) blanking in Corotron/TAB (CTAB) systems. The reason for this is because many printing engines use the spaces between the sheets (interdocument zone or IDZ) to print toner patches used by the various control systems to steer image quality (IQ). Such toner patches are not meant to be transferred or cleaned in this step of the process and, therefore, should be left intact to prevent undesired contamination.

In corotron/TAB systems transfer assist blade blanking is not 100% effective at the leading edge portion and trailing edge portion of the prints due to dependencies on transfer assist blade material dynamic response and the transfer assist blade linkage's inability to react quickly. This issue is aggravated by stress conditions such and wet environment and media conditions, and low stiffness of lightweight media. Sometimes, a 3 mm border is provided around the printing area to safeguard this shortfall; however, questionable performance can still occur in stressful or extreme conditions in an area up to 15 mm from the media edge. Another issue is trail edge flip (TEF) which is a defect band that can occur approximately 45 mm from the trailing edge portion. Trail edge flip affects mainly heavyweight media.

In view of these issues, the embodiments herein provide transfer pressure switching or transfer assist blade switching (in Corotron/TAB systems) to enable print-to-edge performance (0-10 mm from each edge, up to 15 mm in very extreme conditions). This function is achieved by enabling the transfer assist blade to switch from a normal pressure (desired media body pressure, normal state today) to a higher pressure in the trailing edge portion and leading edge portion (20-30% higher pressure) and down to zero pressure (or blanking) in the inter-document zone (to leave the process control patches unaffected). The embodiments herein also extend the trailing edge portion timing flexibility to eradicate trailing edge portion flip (which can occur 45 mm from trailing edge portion).

One exemplary printing apparatus herein includes a charging device positioned adjacent a photoreceptor that places a latent image charge on the photoreceptor. A donor device is adjacent the photoreceptor, and transfers marking material to regions of the photoreceptor that have received the latent image charge. In addition, a media path that is adjacent the photoreceptor places at least one sheet of media on the photoreceptor and the marking material.

A transfer assist blade, that is also adjacent the photoreceptor, presses the sheet of media against the photoreceptor to cause the marking material to be transferred to the sheet of media. Thus, the transfer assist blade applies pressure to push the sheet of media against the photoreceptor when the photoreceptor moves the sheet of media by the transfer assist blade. The transfer assist blade retracts from the photoreceptor after the sheet of media has passed by the transfer assist blade such that the transfer assist blade does not contact the photoreceptor in regions where the photoreceptor is exposed between adjacent sheets of media.

The apparatus also includes a controller that is operatively connected to the transfer assist blade. The controller causes the transfer assist blade to apply more pressure to leading and trailing portions of the sheet of media relative to the middle portion of the sheet of media. The controller causes the transfer assist blade to apply at least 20% greater pressure to the leading and trailing portions relative to the middle portion of the sheet of media. Also, the additional pressure is applied up to approximately 15 mm of the leading edge portion of the sheet of media and is applied up to approximately 60 mm of the trailing edge portion of the sheet of media.

The embodiments herein also include computer storage media and method embodiments. One such method embodiment places at least one sheet of media on a photoreceptor and moves the sheet of media by the transfer assist blade using the photoreceptor while the transfer assist blade applies pressure to push the sheet of media against the photoreceptor. The method causes the transfer assist blade to apply more pressure to leading and trailing portions of the sheet of media relative to a middle portion of the sheet of media using a controller. The method retracts the transfer assist blade from the photoreceptor after the sheet of media has passed by the transfer assist blade so that the transfer assist blade does not contact the photoreceptor in inter-document regions (zones) where the photoreceptor is exposed between adjacent sheets of media.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
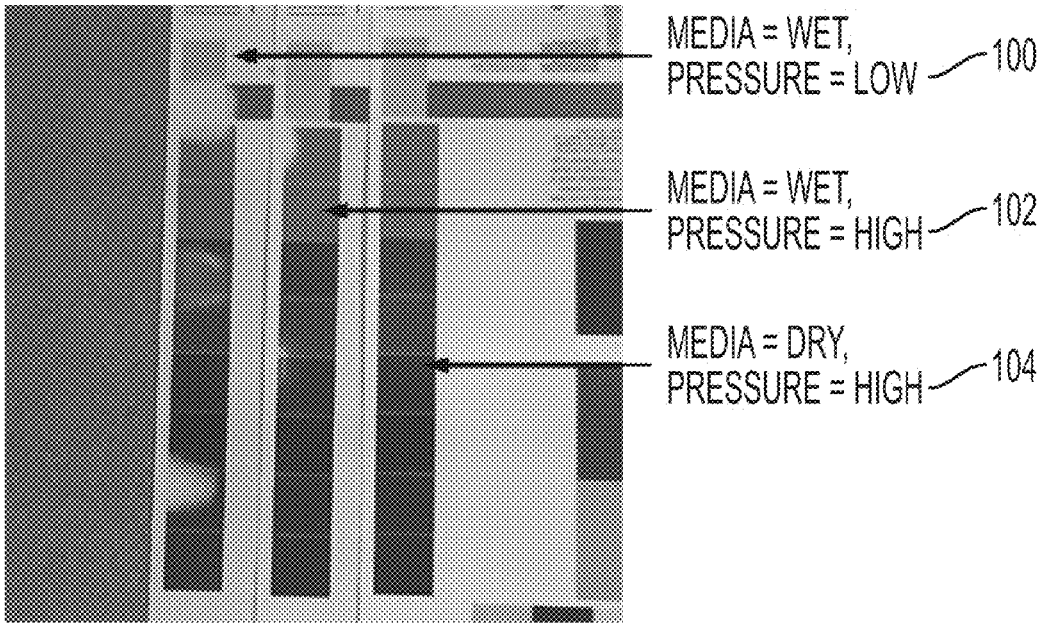
FIG. 1 is a schematic diagram of printing defects according to embodiments herein.

As mentioned above, print-to-edge performance is a very challenging aspect of printing, especially in the lead edge and trail edge of the media where the transfer of toner from the photoreceptor to the media may be influenced by factors such as reverse biasing in bias transfer belt systems or transfer assist blade blanking in Corotron/TAB systems. The reason: many printing engines use the spaces between sheets (interdocument zone or IDZ) to print toner patches used by the control system to steer image quality; these patches are not meant to be transferred or cleaned in this step of the process and therefore must be left intact to prevent undesired contamination.

In bias transfer roller/bias transfer belt (BTR/BTB) systems, the voltage is reverse biased on the bias transfer roller to prevent inter-document zone toner contamination. In this case, a mechanical component (bias transfer roller (BTR)) also applies the electrical field. As the rolls approach the edges the reverse bias (or voltage switching) can be applied almost instantaneously, without affecting the leading edge portion or trailing edge portion of sheet. However, this method by itself (reverse bias w/o bias transfer belt cleaning) works best for low-medium image quality applications where some bias transfer roller/bias transfer belt contamination is not objectionable if it transfers to print. In high image quality markets the bias transfer belt requires a cleaner in order to keep the belt clean and meet image quality requirements. In bias transfer roller/bias transfer belt systems reverse bias and/or bias transfer belt cleaners do enable print-to-edge performance; however, that is at the expense of complexity and cost (high UMC and high Run Cost systems).

In Corotron/TAB systems the situation is somewhat different because the mechanical pressure and electrical field are applied by different devices: mechanical=TAB and electrical=dicorotron. These two work in combination to provide the full transfer function. To clear the inter-document zone patches in Corotron/TAB systems transfer assist blade blanking is used. In other words, the transfer assist blade is deactivated in the inter-document zones to prevent damaging the toner patches. However, this relies on fast transfer assist blade linkage actuation along with a very reactive transfer assist blade dynamic response, to quickly re-apply pressure at the leading edge portion and release pressure at the trailing edge portion.

Because the transfer assist blade function is almost purely mechanical (e.g. the transfer electrical function is applied by a dicorotron just downstream) the response time can sometimes be less adequate than reverse bias in bias transfer belt/bias transfer roller systems. This, in turn, increases risks of artifacts in both the leading edge portion and trailing edge portion of the prints because the transfer pressure from transfer assist blade is inherently lower around the edges as the transfer assist blade engages and disengages to clear the inter-document zone patches. In this respect, the area of questionable performance is approx 0-10 mm from each edge, and up to 15 mm at very extreme conditions (wet environment/media conditions and low stiffness of lightweight media).

FIG. 1 shows three examples of leading edge portion and trailing edge portion deletions (overlaid on one another) as a function of transfer pressure and environmental/media conditions. More specifically, FIG. 1 illustrates a leading edge portion or trailing edge portion deletion 100 that occurs under low pressure with wet media. Item 102 illustrates a leading edge portion or trailing edge portion deletion that occurs under wet conditions where the transfer assist blade is under higher pressure. As can be seen, the edge deletion 100 is more severe than the edge deletion 102 which demonstrates that the increased pressure reduces the amount of deletion (reduces the printing error). Item 104 illustrates that edge deletions can be eliminated when using dry media within a high pressure transfer assist blade.

Figure 2:
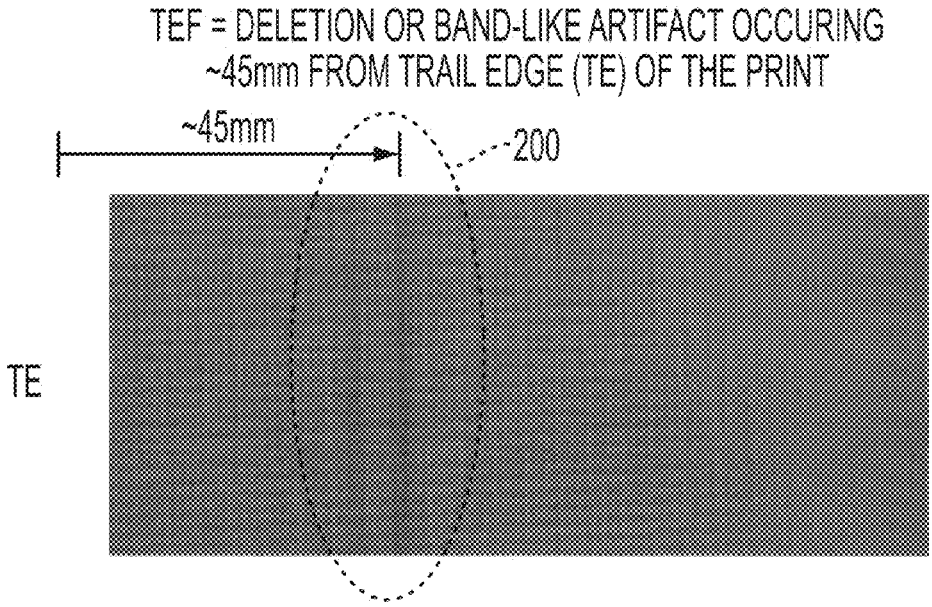
FIG. 2 is a schematic diagram of printing defects according to embodiments herein.

Another condition which occurs is referred to as trail edge flip (TEF), which can sometimes be seen as a band positioned approx 45 mm from the trailing edge portion. This band is illustrated as item 200 in FIG. 2. This artifact 200 is caused by the 'wagging' of the media trailing edge portion after leaving the pre-transfer baffle, and can be caused by the inlet geometry into the transfer area. This trail edge flip condition affects mainly heavyweight media, due to their high stiffness.

In order to address these issues, the embodiments herein provide various structures and methods that apply additional pressure through the transfer assist blade at the end regions of the sheet of media. One such exemplary apparatus is illustrated in FIG. 3.

Figure 3:
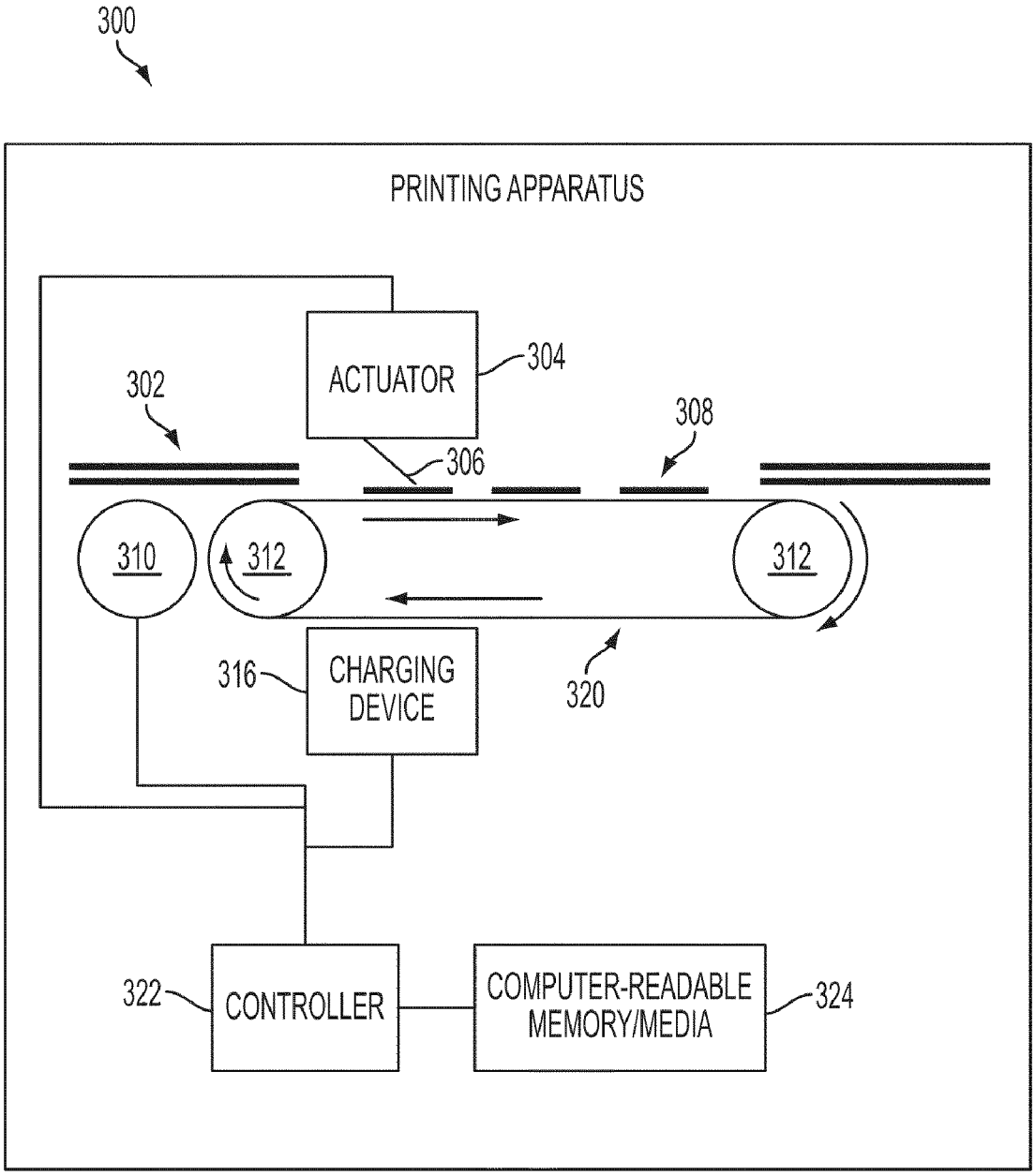
FIG. 3 is a schematic diagram of a printing device according to embodiments herein.

More specifically, FIG. 3 illustrates one exemplary printing apparatus 300 that includes a charging device 316 positioned adjacent a photoreceptor 320 that places a latent image charge on the photoreceptor 320. The photoreceptor 320 is illustrated as being supported by rollers 312; however, as would be understood by those ordinarily skilled in the art, any form of photoreceptor 320 and supporting mechanisms can be utilized. The charging device 316 is generally well-known by those ordinarily skilled in the art and is represented as a single device in the drawings, but is normally a combination of devices such as a corona charging device, a raster output scanner, etc., and other similar devices that have the ability to form a latent image of static charges on the photoreceptor 320.

A donor device 310 is adjacent the photoreceptor 320, and transfers marking material to regions of the photoreceptor 320 that have received the latent image charge. The donor device 310 is generally well-known by those ordinarily skilled in the art, and is also represented as a single device, but can be a combination of devices such as a container that maintains the marking material, the various augers or other intermediate devices that supply the marking material to a donor roll, and other similar devices that have the ability to supply a controlled amount of marking material to the photoreceptor 320. The marking material itself is also generally well-known by those ordinarily skilled in the art and can comprise toner, dry ink, wet ink, powdered marking agents, granular marking agents, etc.

In addition, a media path 302 that is adjacent the photoreceptor 320 places at least one sheet of media 308 on the photoreceptor 320 and the marking material. The media path 302 generally comprises various rollers, belts, sheet supplies, etc., as is known by those ordinarily skilled in the art.

A transfer assist blade 306, that is also adjacent the photoreceptor 320, presses the sheet of media 308 against the photoreceptor 320 to cause the marking material to be transferred to the sheet of media 308. The transfer assist blade 306 is driven by an actuator 304. Thus, the actuator 304 moves the transfer assist blade 306 so that it applies pressure to push the sheet of media 308 against the photoreceptor 320 when the photoreceptor 320 moves the sheet of media 308 by the transfer assist blade 306.

The actuator 304 can comprise any electrically controlled motor that has the ability to move an item, and is an item that is well-known by those ordinarily skilled in the art. The transfer assist blade 306 is also well-known by those ordinarily skilled in the art and generally comprises a rigid mount that connects to the actuator 304 and a somewhat flexible blade end that contacts the sheets of media 308. If high pressure is always utilized when contacting a sheet of media 308, the flexible blade of the transfer assist blade 306 can suffer from excessive wear.

The transfer assist blade 306 retracts from the photoreceptor 320 after the sheet of media 308 has passed by the transfer assist blade 306 so that the transfer assist blade 306 does not contact the photoreceptor 320 in regions where the photoreceptor 320 is exposed between adjacent sheets of media (does not contact the inter-document zone of the photoreceptor 320).

The apparatus also includes a controller 322 that is operatively connected to (directly or indirectly connected to) the transfer assist blade 306. In this case, the transfer assist blade 306 is indirectly connected to the controllers 322 through the actuator 304. The controller 322 can comprise any form of logic control and can include a computerized processor, other computerized device, application specific integrated circuit (ASIC), etc. Further, the controller 322 can be connected to a computer readable memory or media 324 that can store instructions that are executed by the controller 322 to perform the various operations that are described herein.

The controller 322 causes the transfer assist blade 306 to apply more pressure to leading and trailing portions of the sheet of media 308 relative to the middle portion of the sheet of media 308. The controller 322 causes the transfer assist blade 306 to apply at least 20% greater pressure (and can apply additional pressure e.g., 30%, 40%, etc.) to the leading and trailing portions relative to the middle portion of the sheet of media 308. These different pressures are sometimes referred to herein as a relatively normal pressure and a relatively higher pressure, where the relatively higher pressure is a certain percentage higher than the relatively normal pressure.

Figure 4:
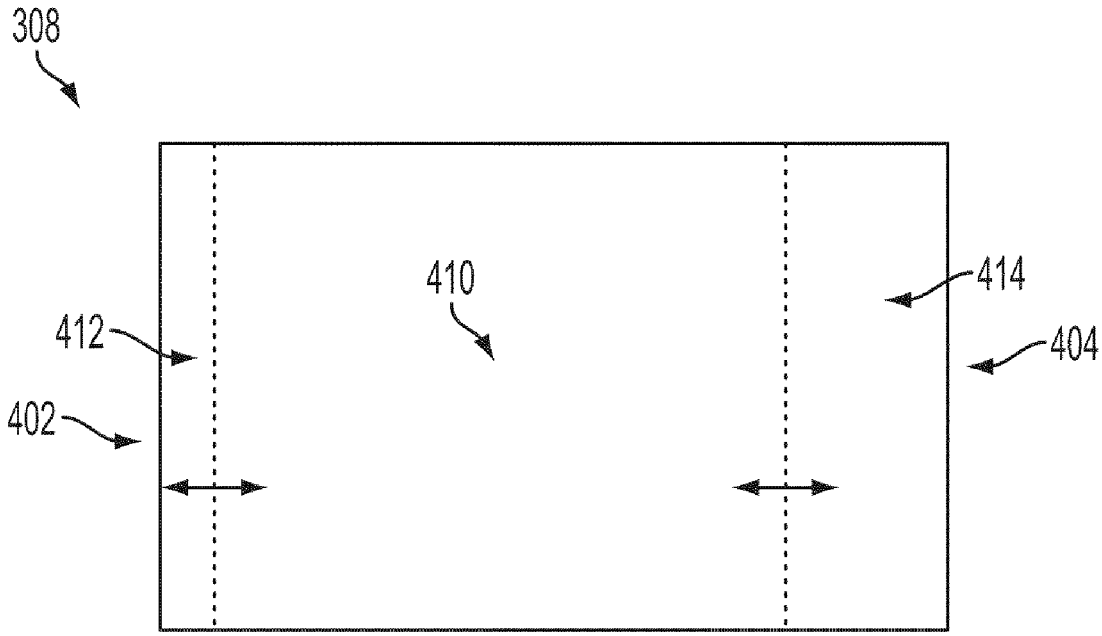
FIG. 4 is a schematic diagram of a sheet of media according to embodiments herein.

In one example, shown in FIG. 4 a sheet of media 308 can have a leading edge portion 412 that is adjacent the leading edge 402 of the sheet of media 308. In addition, the sheet of media can have a trailing edge portion 414 that is immediately adjacent the trailing edge 404 of the sheet of media 308. Further, the sheet of media 308 will have a middle portion 410 that is positioned between the leading edge portion 412 and the trailing edge portion 414.

The additional pressure can be applied up to approximately 15 mm of the leading edge portion 412 of the sheet of media 308 (e.g., 2 mm, 5 mm, 10 mm, etc., of the leading edge portion 412 of the sheet 308) and can be applied up to approximately 60 mm of the trailing edge portion 414 of the sheet of media 308 (e.g., 2 mm, 5 mm, 20 mm, 40 mm etc., of the trailing edge portion of the sheet). Stated as a percentage, the additional pressure can be applied up to a first percentage (e.g., 1%, 3%, 5%, 10%, etc.) of the leading edge portion 412 of the sheet of media 308 and can similarly be applied to a certain last percentage (e.g., 1%, 3%, 5%, 10%, 20%, 40%) of the trailing edge portion 414 of the sheet of media 308. Note that the amount of the leading edge portion 412 that receives the additional pressure can be different than the amount of trailing edge portion 414 of the sheet of media 308 that receives the additional pressure. These percentages represent the values for one example; however, the embodiments herein do not limit how far in one can go, depending on the noises, i.e. one can set to larger than 15 or 60 mm as needed, taking into account that the farther in, the more wear on the transfer assist blade. In other words these edge boundaries are settable by a pre-determined value for the process at hand.

Figure 5:
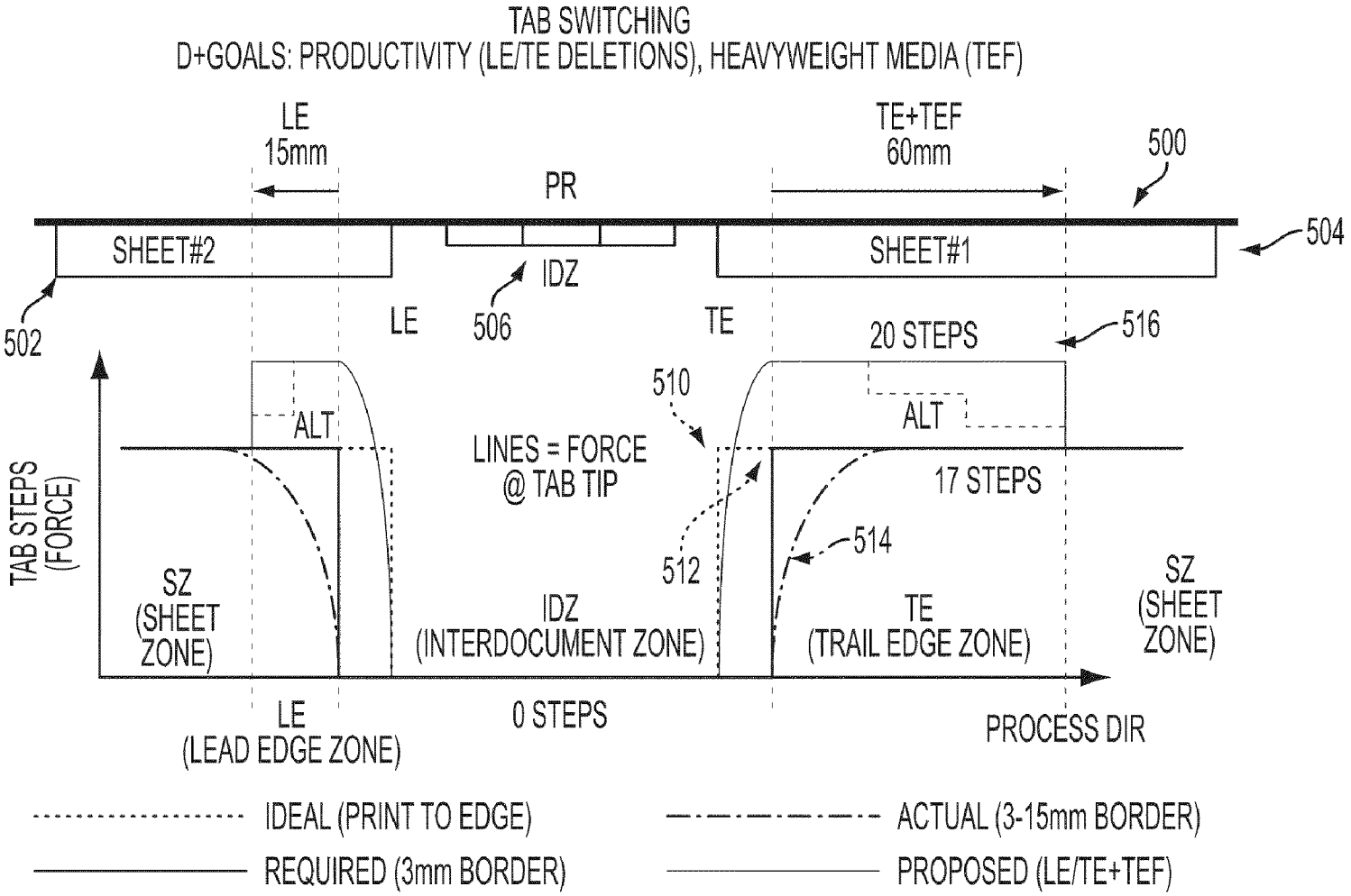
FIG. 5 is a schematic diagram illustrating different forces applied by a transfer assist blade according to embodiments herein.

FIG. 5 graphically and schematically illustrates the different pressures that are applied to the leading edge portion 412 and the trailing edge portion 414 of the sheet of media 308. More specifically, FIG. 5 illustrates a photoreceptor 500 that has sheets 502, 504 positioned thereon, with an inter-document zone 506 between the sheets 502, 504. The graphic lines 510, 512, 514, 516 below the schematic drawings of the sheets 502, 504 illustrate the different forces that are applied to the sheets by the transfer assist blade 306.

For example, line 510 in FIG. 5 is an ideal line in which the actuator 304 has the ability to move the transfer assist blade 306 instantly. Therefore, the line 510 has a very sharp angle that occurs almost directly at the leading and trailing edges of the sheets 502, 504. Another line 512 which has the same shape as line 510 represents another theoretical situation in which the actuator 304 has the ability to move the transfer assist blade 306 instantly, and that moves the transfer assist blade 306 into contact with the sheets within a 3 mm border of the leading or trailing edge of the sheet.

In FIG. 5, lines 514 and 516 represent real world situations in which a certain time expires when the actuator 304 is moving the transfer assist blade 306. Line 514 represents situations where a constant pressure level is applied to the sheets of media 308 from the time when the actuator can first apply the pressure until the time when the actuator removes the pressure.

To the contrary, line 516 represents the various embodiments discussed above in which additional pressure is applied within the leading edge portion 412 and the trailing edge portion 414 of the sheets of media 308. Note that in FIG. 5, the additional pressure is applied almost immediately (within the first 3 mm of the leading edge portion 412) and is maintained very late through the trailing edge portion 414 (again within the last 3 mm). Between the leading edge portion 412 and the trailing edge portion 414, the pressure applied by the transfer assist blade 306 to the middle portion of the sheet 410 reduces to the same normal pressure that applied in all other situations (lines 510, 512, and 514).

Further, as illustrated by the dashed portions of line 516 in FIG. 5, the embodiments herein also have the ability to increase or reduce the pressure in various steps (gradually) when changing the pressure between the relatively normal pressure applied to the middle portion 510 of the sheet of media 308 and the relatively increased pressure applied to the leading edge portion 412 and the trailing edge portion 412 of the sheets of media 308.

Thus, as shown above, the embodiments herein use "transfer pressure switching" to increase the load applied to the back of the substrate by the transfer assist blade in the leading and trailing edge regions. In current printers the transfer assist blade is brought into contact with the back of the sheet just after the lead edge passes beneath it, and it lifts out of contact with the sheet just prior to the trial edge. Also, in current printers, the transfer assist blade pressure is held constant from the leading edge to the trailing edge. The embodiments herein increase the pressure applied by the transfer assist blade and the leading and trailing edge regions, which reduces leading and trailing edge deletions, and edge flip defects that occur at the trail edge with heavyweight stock. Simply increasing the transfer assist blade pressure throughout the sheet would increase the transfer assist blade wear rate and reduce the life of the assembly significantly. Further, increasing the pressure on the entire length of the sheet can cause the transfer assist blade actuator to skip due to borderline torque capacity at long holding currents (full paper length), and excessive drag on the sheet that may induce stalling/jams in the transfer area.

Figure 6:
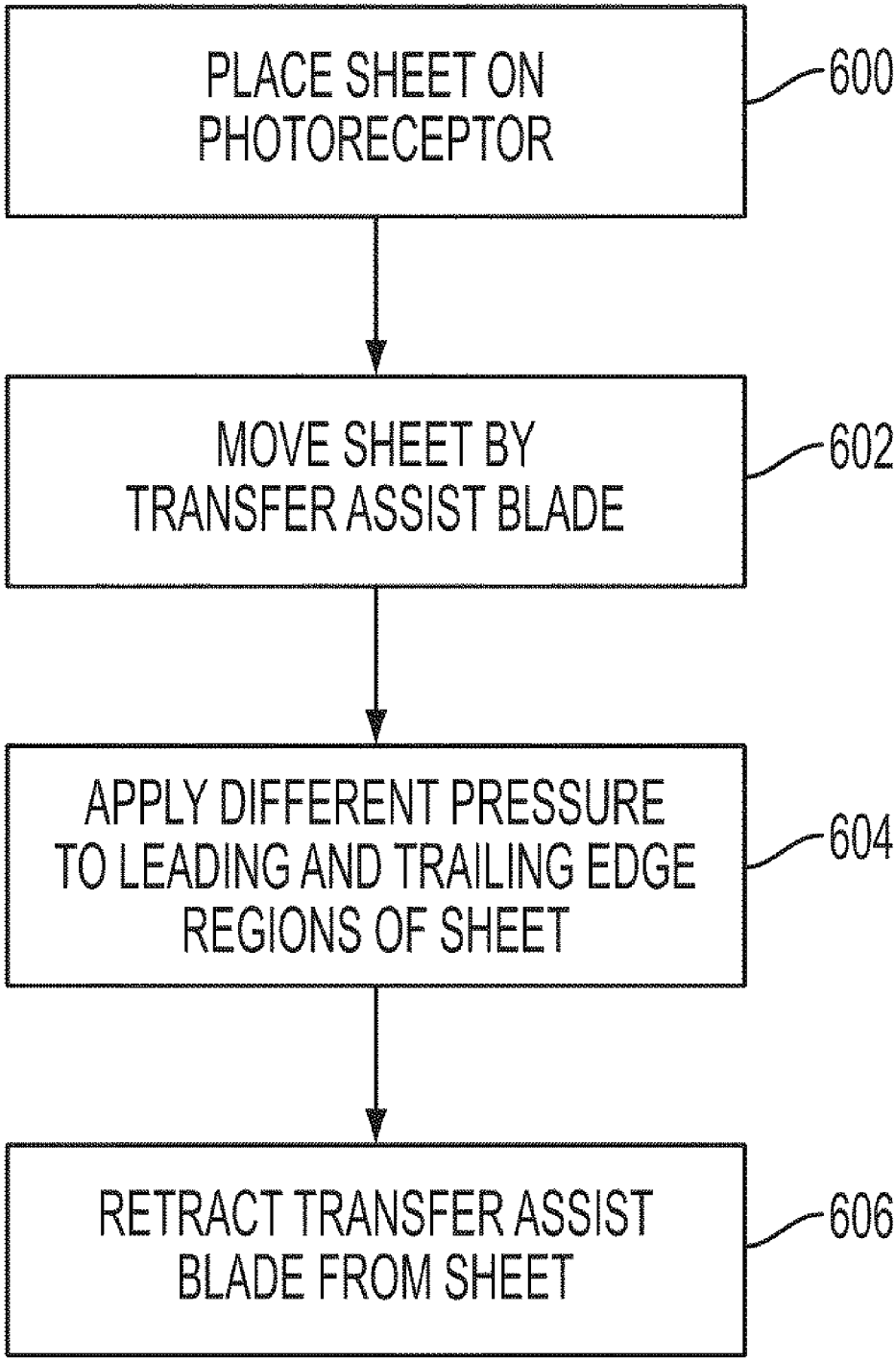
FIG. 6 is a flow chart illustrating embodiments herein.

The embodiments herein also include computer storage media and method embodiments, as illustrated in FIG. 6. As shown in the flowchart in FIG. 6, in item 600, the embodiments herein place at least one sheet of media on a photoreceptor. Then, in item 602, the embodiments herein move the sheet of media by the transfer assist blade using the photoreceptor. In item 604, the transfer assist blade applies pressure to push the sheet of media against the photoreceptor. In item 604, the embodiments herein cause the transfer assist blade to apply more pressure to leading and trailing portions of the sheet of media relative to the middle portion of the sheet of media using the controller. In item 606, the method retracts the transfer assist blade from the photoreceptor after the sheet of media has passed by the transfer assist blade so that the transfer assist blade does not contact the photoreceptor in inter-document regions (zones) where the photoreceptor is exposed between adjacent sheets of media.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. An apparatus comprising:

a photoreceptor that contacts at least one sheet of media;

a transfer assist blade adjacent said photoreceptor, said transfer assist blade pressing said sheet of media against said photoreceptor; and a controller operatively connected to said transfer assist blade, said controller causing said transfer assist blade to apply more pressure to leading and trailing portions of said sheet of media relative to a middle portion of said sheet of media.

2. The apparatus according to claim 1, said more pressure being applied to said leading and trailing portions of said sheet of media being at least 20% greater than pressure applied to said middle portion of said sheet of media.

3. The apparatus according to claim 1, said more pressure being applied up to approximately 15 mm of a leading edge portion of said sheet of media and said more pressure being applied up to approximately 60 mm of a trailing edge portion of said sheet of media.

4. The apparatus according to claim 1, said transfer assist blade applies pressure to push said sheet of media against said photoreceptor when said photoreceptor moves said sheet of media by said transfer assist blade.

5. The apparatus according to claim 1, said transfer assist blade retracting from said photoreceptor after said sheet of media has passed by said transfer assist blade such that said transfer assist blade does not contact said photoreceptor in regions where said photoreceptor is exposed between adjacent sheets of media.

6. A printing apparatus comprising:

a charging device;

a photoreceptor adjacent said charging device, said charging device placing a latent image charge on said photoreceptor;

a donor device adjacent said photoreceptor, said donor device transferring marking material to regions of said photoreceptor that have received said latent image charge;

a media path adjacent said photoreceptor, said media path placing at least one sheet of media on said photoreceptor and said marking material;

a transfer assist blade adjacent said photoreceptor, said transfer assist blade pressing said sheet of media against said photoreceptor to cause said marking material to be transferred to said sheet of media; and a controller operatively connected to said transfer assist blade, said controller causing said transfer assist blade to apply more pressure to leading and trailing portions of said sheet of media relative to a middle portion of said sheet of media.

7. The apparatus according to claim 6, said more pressure being applied to said leading and trailing portions of said sheet of media being at least 20% greater than pressure applied to said middle portion of said sheet of media.

8. The apparatus according to claim 6, said more pressure being applied up to approximately 15 mm of a leading edge portion of said sheet of media and said more pressure being applied up to approximately 60 mm of a trailing edge portion of said sheet of media.

9. The apparatus according to claim 6, said transfer assist blade applies pressure to push said sheet of media against said photoreceptor when said photoreceptor moves said sheet of media by said transfer assist blade.

10. The apparatus according to claim 6, said transfer assist blade retracting from said photoreceptor after said sheet of media has passed by said transfer assist blade such that said transfer assist blade does not contact said photoreceptor in regions where said photoreceptor is exposed between adjacent sheets of media.

11. A method comprising:

placing at least one sheet of media on a photoreceptor;

pressing said sheet of media against said photoreceptor using a transfer assist blade; and causing said transfer assist blade to apply more pressure to leading and trailing portions of said sheet of media relative to a middle portion of said sheet of media using a controller.

12. The method according to claim 11, said more pressure being applied to said leading and trailing portions of said sheet of media being at least 20% greater than pressure applied to said middle portion of said sheet of media.

13. The method according to claim 11, said more pressure being applied up to approximately 15 mm of a leading edge portion of said sheet of media and said more pressure being applied up to approximately 60 mm of a trailing edge portion of said sheet of media.

14. The method according to claim 11, further comprising moving said sheet of media by said transfer assist blade using said photoreceptor while said transfer assist blade applies pressure to push said sheet of media against said photoreceptor.

15. The method according to claim 11, further comprising retracting said transfer assist blade from said photoreceptor after said sheet of media has passed by said transfer assist blade such that said transfer assist blade does not contact said photoreceptor in regions where said photoreceptor is exposed between adjacent sheets of media.

16. A non-transitory computer storage medium readable by a controller, said computer storage medium storing instructions causing said controller to perform a method comprising:

placing at least one sheet of media on a photoreceptor;

pressing said sheet of media against said photoreceptor using a transfer assist blade; and causing said transfer assist blade to apply more pressure to leading and trailing portions of said sheet of media relative to a middle portion of said sheet of media using a controller.

17. The non-transitory computer storage medium according to claim 16, said more pressure being applied to said leading and trailing portions of said sheet of media being at least 20% greater than pressure applied to said middle portion of said sheet of media.

18. The non-transitory computer storage medium according to claim 16, said more pressure being applied up to approximately 15 mm of a leading edge portion of said sheet of media and said more pressure being applied up to approximately 60 mm of a trailing edge portion of said sheet of media.

19. The non-transitory computer storage medium according to claim 16, said method further comprising moving said sheet of media by said transfer assist blade using said photoreceptor while said transfer assist blade applies pressure to push said sheet of media against said photoreceptor.

20. The non-transitory computer storage medium according to claim 16, said method further comprising retracting said transfer assist blade from said photoreceptor after said sheet of media has passed by said transfer assist blade such that said transfer assist blade does not contact said photoreceptor in regions where said photoreceptor is exposed between adjacent sheets of media.

* * * * *